US012137815B2

(12) United States Patent
Mimura et al.

(10) Patent No.: US 12,137,815 B2
(45) Date of Patent: Nov. 12, 2024

(54) SEAT CUSHION

(71) Applicant: MOLTEN CORPORATION, Hiroshima (JP)

(72) Inventors: Maki Mimura, Hiroshima (JP); Hiroshi Ohno, Hiroshima (JP); Kiyofumi Tamiaki, Hiroshima (JP); Ryuji Kajiwara, Hiroshima (JP); Shuhei Yasuhara, Hiroshima (JP)

(73) Assignee: MOLTEN CORPORATION, Hiroshima (JP)

( * ) Notice: Subject to any disclaimer, the term of this patent is extended or adjusted under 35 U.S.C. 154(b) by 278 days.

(21) Appl. No.: 17/618,359

(22) PCT Filed: Sep. 10, 2020

(86) PCT No.: PCT/JP2020/034323

§ 371 (c)(1),
(2) Date: Dec. 10, 2021

(87) PCT Pub. No.: WO2021/049577

PCT Pub. Date: Mar. 18, 2021

(65) Prior Publication Data

US 2022/0257024 A1 Aug. 18, 2022

(30) Foreign Application Priority Data

Sep. 13, 2019 (JP) ..... 2019-167779

(51) Int. Cl.

| | |
|---|---|
| ***A47C 27/10*** | (2006.01) |
| ***A47C 27/08*** | (2006.01) |
| ***A47C 27/18*** | (2006.01) |

(52) U.S. Cl.

CPC ..... *A47C 27/10* (2013.01); *A47C 27/082* (2013.01); *A47C 27/083* (2013.01); *A47C 27/18* (2013.01)

(58) Field of Classification Search

CPC ..... A47C 7/021; A47C 7/0213; A47C 27/10; A61G 5/1045; A47G 9/1027

(Continued)

(56) References Cited

U.S. PATENT DOCUMENTS 1,468,072 A * 9/1923 Ogle ..... A47C 27/081 128/DIG. 20
2,156,629 A * 5/1939 Hutchison ..... A47C 7/0213 5/652

(Continued)

FOREIGN PATENT DOCUMENTS

CN 102218000 A * 10/2011
CN 113950273 A * 1/2022 ..... A47C 27/082

(Continued)

OTHER PUBLICATIONS

European Patent Office; Extended European Search Report for Application No. 20862270.4 dated Sep. 7, 2023.

(Continued)

*Primary Examiner* — Eric J Kurilla
(74) *Attorney, Agent, or Firm* — Parsons Behle & Latimer

(57) ABSTRACT

According to one embodiment, a seat cushion comprises a second air cell section that is located on the rear side of a seat surface and a third air cell section that is located rearward of the second air cell section. The second air cell section and the third air cell section are adjacent to each other and have a common boundary extending diagonally in the front-rear direction of the seat surface such that the ischial region of a user fits in the boundary.

6 Claims, 4 Drawing Sheets

(58) Field of Classification Search
USPC ..... 5/653
See application file for complete search history.

(56) References Cited

U.S. PATENT DOCUMENTS

| | | | | | |
|---|---|---|---|---|---|
| 2,551,084 | A * | 5/1951 | Aronov | B60N 2/38 | 297/229 |
| 5,378,045 | A * | 1/1995 | Siekman | A61G 5/1043 | 297/452.41 |
| 6,367,106 | B1 | 4/2002 | Gronsman | | |
| 7,225,486 | B2 * | 6/2007 | Jackson, III | A61G 5/1043 | 5/653 |
| 7,350,251 | B2 * | 4/2008 | Fraser | B62J 1/26 | 5/653 |
| 2019/0125094 | A1 * | 5/2019 | Sprouse | A47C 7/021 | |

FOREIGN PATENT DOCUMENTS

| | | | | | |
|---|---|---|---|---|---|
| GB | 2346084 | A * | 8/2000 | A61G 5/1045 | |
| JP | 201063744 | A | 3/2010 | | |
| JP | 2012000401 | A | 1/2012 | | |
| JP | 2013518620 | A | 5/2013 | | |
| JP | 2013116227 | A * | 6/2013 | | |
| JP | 3192705 | U | 8/2014 | | |
| JP | WO2017/021996 | A1 | 2/2017 | | |
| WO | WO-2021049577 | A1 * | 3/2021 | A47C 27/082 | |

OTHER PUBLICATIONS

Japan Patent Office; International Search Report and Written Opinion for Application No. PCT/JP2020/034323 dated Mar. 18, 2021.

* cited by examiner

| AIR CELL INTERNAL PRESSURE [kPa] | STABLE MODE | DECOMPRESSION MODE (PRESSURE VALUE) |
|---|---|---|
| SOFT | 4.0 | 4.2 |
| MEDIUM | 5.2 | 5.5 |
| FIRM | 6.5 | 6.8 |

| DISCHARGE/SWITCH TIME [sec] | AIR CELL ZF (42) | SWITCH | AIR CELL ZB (43) |
|---|---|---|---|
| SOFT | 12 | 20 | 10 |
| MEDIUM | 13 | 22 | 11 |
| FIRM | 14 | 24 | 12 |

SEAT CUSHION

CROSS-REFERENCE TO RELATED APPLICATIONS

This application is the National Stage of International Application No. PCT/JP2020/034323 filed Sep. 9, 2020 which claims priority under 35 U.S.C. § 119(b) to Japanese Patent Application No. 2019-167779 filed Sep. 13, 2019, the entire contents of each of which are hereby incorporated by reference in their entirety.

TECHNICAL FIELD

The present invention relates to a seat cushion.

BACKGROUND

There have been proposed cushions that allow a user seated thereon to stabilize the position of their buttocks and effectively prevent the development of pressure ulcers. Patent Document 1 discloses one example of such a cushion. Specifically, the cushion includes first air cells each capable of softly supporting the vicinity of the ischium in the vertical and horizontal directions. A convex portion is provided on the front side of the air cell group in the front-rear direction of the seat surface. Inclined convex portions are arranged on both sides of the convex portion in the width direction of the seat surface. The convex portion suppresses the movement of both thighs in the width direction of the seat surface. Besides, the convex portion and the inclined convex portions suppress the forward movement of the buttocks. Thereby, the position of the buttocks of a user seated on the cushion can be stabilized, and the development of pressure ulcers can be effectively prevented.

PRIOR ART DOCUMENT

Patent Document

Patent Document 1: Japanese Unexamined Patent Application Publication No. 2010-63744

SUMMARY

However, with the air cell arrangement of the conventional cushions, it is difficult to achieve both stability and body pressure dispersion around the user's ischial region; with the conventional vertical arrangement, horizontal arrangement, grid arrangement, staggered arrangement, or the like, the user cannot be stably supported and their posture can easily slump forward.

The present disclosure has been made in view of the above problems. Accordingly, it is one object of the present disclosure to provide a seat cushion that achieves both stability and body pressure dispersion around the user's ischial region and that allows the user to control the cushioning performance as they wish.

To achieve the object mentioned above:

(1) According to the first aspect, a seat cushion includes a second air cell section that is located on the rear side of a seat surface, and a third air cell section that is located rearward of the second air cell section. The seat cushion is characterized in that the second air cell section and the third air cell section are adjacent to each other and have a common boundary extending diagonally in the front-rear direction of the seat surface such that the ischial region of a user fits in the boundary.

(2) In the configuration (1) described above, the second air cell section is configured to support part of the buttocks of the user anterior to the ischial region, while the third air cell section is configured to support part of the buttocks of the user posterior to the ischial region.

(3) In the configuration (1) or (2), the seat cushion further includes a control unit configured to cause the second air cell section and the third air cell section to be alternately decompressed.

(4) In the configuration (3), the control unit is further configured to control the alternate decompression of the second air cell section and the third air cell section such that the second air cell section or the third air cell section is decompressed for 3 to 120 seconds.

(5) In the configuration (3) or (4), the control unit is further configured to perform decompression so as to cause ventilation to occur through a groove formed in a base material of the seat cushion and a slit between the second air cell section and the third air cell section located inside a position corresponding to the boundary to help the user feel less stuffy and sweaty around the ischial region.

(6) In the configuration of any one of (1) to (5), the seat cushion further includes a first air cell section that is located on the front side of the seat surface forward of the second air cell section.

(7) In the configuration (6), the first air cell section is configured to support the thighs of the user.

(8) In the configuration (3), the seat cushion further includes a first air cell section that is located on the front side of the seat surface forward of the second air cell section. The first air cell section is configured to support the thighs of the user. The control unit is further configured to cause the first air cell section to constantly support the thighs of the user.

Effects

According to one aspect, it is possible to provide a seat cushion that achieves both stability and body pressure dispersion around the user's ischial region and that allows the user to control the cushioning performance as they wish.

BRIEF DESCRIPTION OF THE DRAWINGS

FIG. 1(*a*) is an external view of the seat cushion with a cover, FIG. 1(*b*) is an external view of the seat cushion without a cover, FIG. 1 (*c*) illustrates sections of air cells, and FIG. 1(*d*) is a cross-sectional view of the seat cushion.

DETAILED DESCRIPTION

Figure 1:
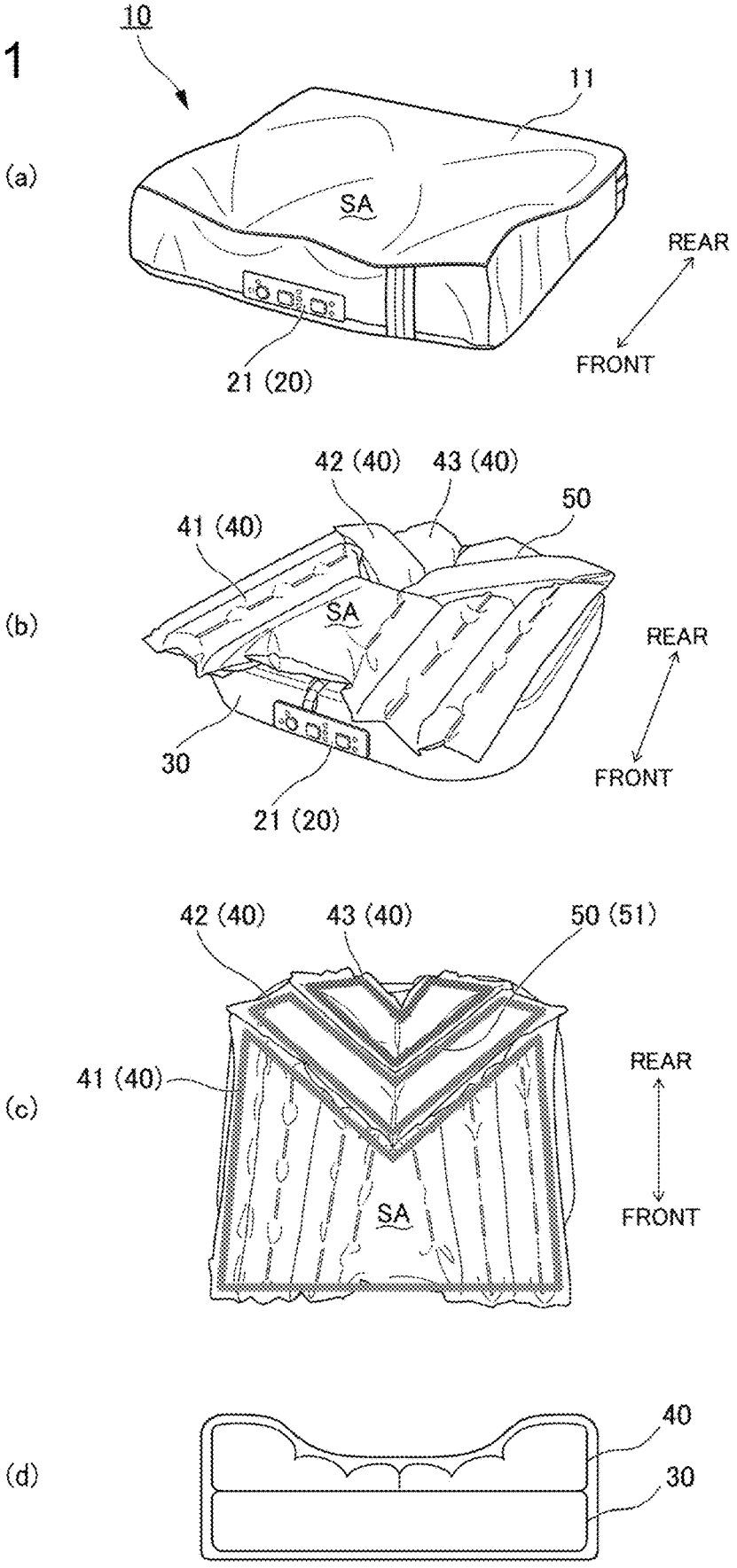
FIG. 1 is a perspective view of a seat cushion according to an embodiment.

In the following, modes (hereinafter, "embodiments") will be described in detail with reference to the accompanying drawings. Note that like parts are designated by like reference numerals or characters throughout the description of the embodiments.

EMBODIMENT

FIG. 1(*a*) is an external view of a seat cushion 10 according to an embodiment. The seat cushion 10 is covered with a breathable and stretchable cover 11 and provided with a control unit 20 having an operation panel 21 that is exposed on the front surface. FIG. 1(*b*) is an external view of the seat cushion 10 without the cover 11. As illustrated in FIG. 1(*b*), the seat cushion 10 includes a base material (for example, urethane foam) and air cells 40 arranged thereon. Air can be supplied to and discharged from the air cells 40. As will be described in detail later, the control unit 20 is built in the seat cushion 10 to control air supply/discharge for the air cells 40 and the like.

The air cells 40 include a first air cell section 41 located on the front side of a seat surface SA, a second air cell section 42 located rearward of the first air cell section 41, and a third air cell section 43 located rearward of the second air cell section 42. The second air cell section 42 and the third air cell section 43 are adjacent to each other and have a common boundary 50 extending diagonally in the front-rear direction of the seat surface SA. Those air cell sections are formed such that the ischial region of the user seated on the seat cushion 10 fits in the boundary 50. Inside the position corresponding to the boundary 50, there is a slit 51 that separates the second air cell section 42 and the third air cell section 43, and a groove 31 is formed in the base material 30 as illustrated in FIG. 1(*d*).

In this embodiment, as illustrated in FIG. 1(*c*), the second air cell section 42 and the third air cell section 43 are formed in a V shape that points toward the front direction, and therefore the boundary 50 between them is also in a V shape. However, in order that the ischial region of the user may fit in a gap at the boundary 50, the second air cell section 42 and the third air cell section 43 need not necessarily be formed in a V shape. The shape of the second air cell section 42 and the third air cell section 43 is not particularly limited as long as they are adjacent to each other and have a common boundary 50 extending diagonally in the front-rear direction of the seat surface SA.

The first air cell section 41 supports the user's thighs, the second air cell section 42 supports part of the user's buttocks anterior to the ischial region, and the third air cell section 43 supports part of the user's buttocks posterior to the ischial region. The ischial region fits in the gap at the boundary 50 that extends diagonally. As a result, the ischial region is enclosed from the front and the rear. Thereby, it is possible to achieve both stability and body pressure dispersion around the user's ischial region.

As described above, the seat cushion 10 is provided with the control unit 20 to supply the air to or discharge the air from each of the air cells 40. As will be described in detail later, under the control of the control unit 20, the second air cell section 42 and the third air cell section 43 are alternately decompressed (deflated) while the first air cell section 41 constantly supports the thighs of the user. Since the seat cushion 10 does not support the part directly below the ischial bones, the buttocks can be prevented from sinking even when the second air cell section or the third air cell section 43 is decompressed. Accordingly, the posture of the user does not slump easily. Thus, the seat cushion 10 can also be suitably used for the seat of a moving object such as a wheelchair.

The control unit 20 controls the alternate decompression of the second air cell section 42 and the third air cell section 43 such that the second air cell section 42 or the third air cell section 43 is decompressed for 3 to 120 seconds. The decompression time is set to be short to maintain the stability. Besides, the control unit 20 performs the control such that the air is discharged from the third air cell section 43 when the pressure in the second air cell section 42 is stabilized after the air is discharged from and then supplied to the second air cell section 42. With this, the decompression time for alternately decompressing the second air cell section 42 and the third air cell section 43 can be shortened, which ensures the stability.

Figure 2:
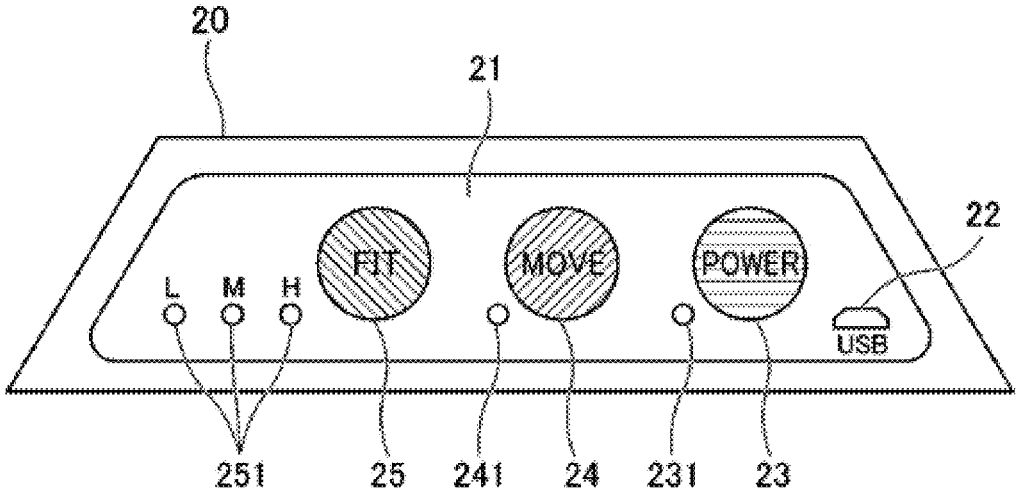
FIG. 2 is a diagram for explaining an operation panel of the seat cushion.

FIG. 2 illustrates an enlarged view of the operation panel 21 of the control unit 20 arranged on the front surface of the seat cushion 10. The operation panel 21 includes a power input port 22 (illustrated for example as a micro USB port in FIG. 2), a POWER switch 23 for turning the power on/off, and a POWER lamp 231 that turns on/off in response to an operation on the POWER switch 23. The operation panel further includes a MOVE switch 24 for selecting the support mode of the seat cushion 10, a MOVE lamp 241 that turns on/off in response to an operation on the MOVE switch 24, a FIT switch 25 for selecting the firmness of the cushion, and three FIT lamps 251 each indicating a selected firmness (L, M, H). The specific operations and functions of them will be described below in the description of the control unit.

(Control Unit)

Figure 3:
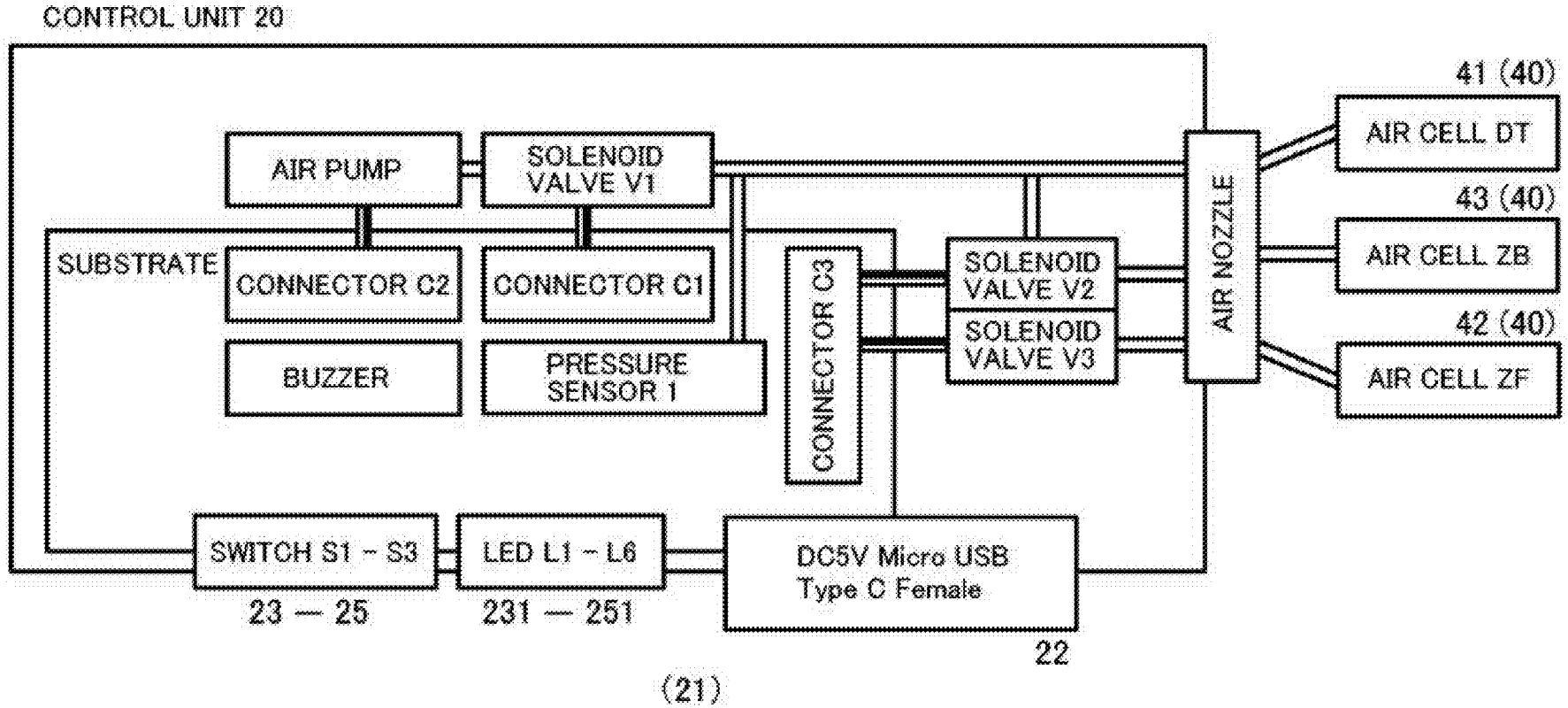
FIG. 3 is a block diagram of a control unit of the seat cushion.
Figures 4, 5, 6:
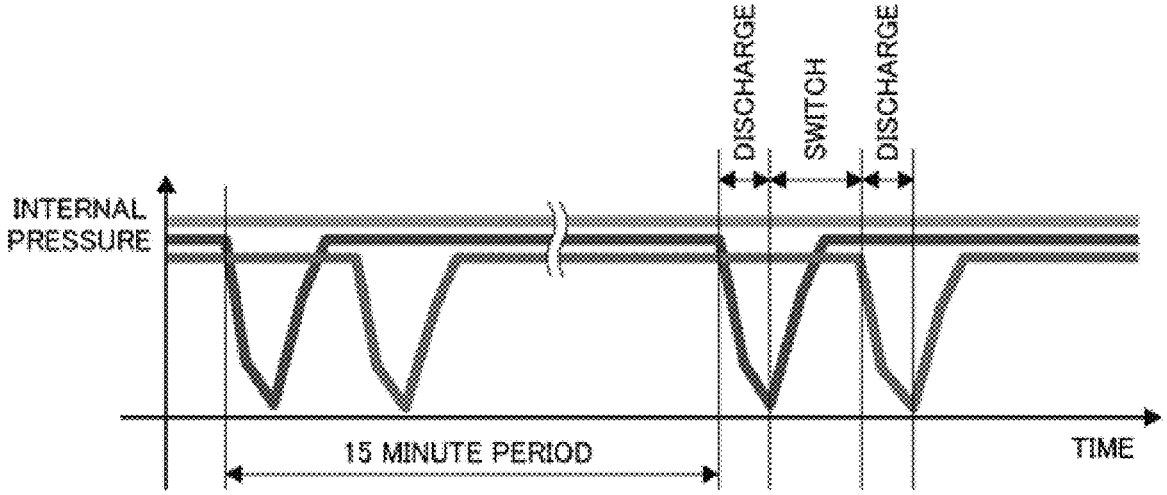
FIG. 4 is a time chart illustrating the internal pressure of the air cells in decompression control.
FIG. 5 is a table illustrating an example of the values of the internal pressure of the air cells.
FIG. 6 is a table illustrating an example of discharge/switch time in decompression mode.

A detailed description will be given of the control unit 20 with reference to FIGS. 3 to 6 based on the structure of the seat cushion 10 described above. FIG. 3 is a block diagram of the control unit 20 of the seat cushion 10. FIG. 4 is a time chart illustrating the internal pressure of the air cells in decompression control. FIG. 5 is a table illustrating an example of the values of the internal pressure of the air cells. FIG. 6 is a table illustrating an example of discharge/switch time in decompression mode. It should be noted that the configuration of the control unit 20 is not limited to the example illustrated in FIG. 3. Although a preferred embodiment and configuration for achieving power saving, compactness, and low cost will be described below with reference to FIG. 3, the operation of the seat cushion 10 may be implemented in other manners.

As illustrated in FIG. 3, the control unit 20 of the seat cushion 10 compresses and decompresses the air in an air cell DT 41 (the first air cell section 41), an air cell ZF 42 (the second air cell section 42), and an air cell ZB 43 (the third air cell section 43) using an air pump, solenoid valves V1 to V3, and an air nozzle based on an operation on the operation panel 21 described above. The solenoid valve V1 is connected to a substrate via a connector C1, and the air pump is connected to the substrate via a connector C2. Similarly, the solenoid valves V2 and V3 are connected to the substrate via a connector C3. In the following, the control configuration and procedures of the seat cushion 10 will be described in detail.

Input Configuration

The control unit 20 is provided with various input interfaces. As illustrated in FIG. 3, the operation panel 21 includes the power input port 22 (illustrated for example as a micro USB Type C female in FIG. 3), a start/stop switch S1 (the POWER switch 23), a support mode selection switch S2 (the MOVE switch 24), and a firmness selection switch S3 (the FIT switch 25). The internal substrate is provided with a pressure sensor 1 configured to detect the internal pressure of the air cells.

(Output Configuration)

The control unit 20 is also provided with various output interfaces. The operation panel 21 includes an LED L1 (the POWER lamp 231) that lights up when the power is turned on, an LED L2 that lights up in the stable mode selected as the support mode, and an LED L3 (the MOVE lamp 241) that lights up in the decompression mode selected as the support mode (the stable mode may be indicated by the turning off of the LED L3, and therefore the description of the LED L2 will be omitted below). The operation panel 21 further includes an LED L4 (lamp L in the FIT lamps 251) that lights up when "soft" is selected from firmness options, an LED L5 (lamp M in the FIT lamps 251) that lights up when "medium" is selected from the options, and an LED L6 (lamp H in the FIT lamps 251) that lights up when "firm" is selected from the options. Inside the control unit 20, there are arranged the air pump configured to supply the air to the air cells 40 (41 to 43), the solenoid valve V1 (two-way valve) configured to open and close the air pump, the solenoid valve V2 (three-way valve) configured to discharge the air from the air cell ZB 43, and the solenoid valve V3 (three-way valve) configured to discharge the air from the air cell ZF 42. The control unit 20 further includes a buzzer to warn of an operational error or the like.

(Control Procedure<Input>)

Described below are control procedures for input operation. When the start/stop switch S1 is held down at the time of OFF, the control unit 20 is turned on and lights up the LED L1, and then enters the standby mode. On the other hand, when the start/stop switch S1 is held down at the time of ON, the control unit 20 turns the LED L1 off and is turned off, and the control shifts to "termination control".

The support mode selection switch S2 is activated in a support mode used in the previous activation. The LED L3 is turned on when the support mode is "decompression mode", while the LED L3 is off when the support mode is "stable mode". Each time the support mode selection switch S2 is pressed, the support mode is switched between the stable mode and the decompression mode ("stable"⇒"decompression"⇒"stable"⇒ . . . ).

The firmness selection switch S3 is activated with a firmness option used in the previous activation, and a corresponding one of the LEDs L4 to L6 is turned on. Each time the firmness selection switch S3 is pressed, the firmness is switched among medium, firm and soft ("medium"⇒"firm"⇒"soft"⇒"medium"⇒ . . . ).

(Control Procedure<Operation Mode Control>)

In the stable mode of the standard control, the internal pressure of the air cells is adjusted in the stable mode by the following procedure in a state where the user is seated. First, the control moves to "internal pressure adjustment control" for adjusting the internal pressure of a corresponding one of the air cells 40, and the internal pressure is obtained by the pressure sensor 1. After the lapse of 30 seconds while the internal pressure is less than −0.5 kPa of the set pressure value, or +0.5 kPa of the set pressure value or more, the control returns to the start of the internal pressure adjustment control. When the support mode is changed, the mode shifts to the decompression mode. It should be noted that the values such as the set pressure value and the elapsed time are described herein only by way of example and not to be construed as limiting the embodiments.

In the decompression mode of the standard control, the internal pressure of the air cells is adjusted in the automatic mode by the following procedure in a state where the user is seated. First, the control moves to the internal pressure adjustment control for adjusting the internal pressure of a corresponding one of the air cells 40. The control shifts to "decompression control" when 15 minutes or more have passed since the previous decompression control. Then, the internal pressure is obtained by the pressure sensor 1. After the lapse of 30 seconds while the internal pressure is less than −0.5 kPa of the set pressure value, or +0.5 kPa of the set pressure value or more, the control returns to the start of the internal pressure adjustment control. When the support mode is changed, the mode shifts to the stable mode.

In the termination control for terminating the operation, after moving to the internal pressure adjustment control for adjusting the internal pressure of a corresponding one of the air cells 40, the control enters the wait mode for waiting for an input from the switches S1, S2 and S3, and all the outputs are turned off.

(Control Procedure<Air Cell Internal Pressure Control>)

The decompression control is performed to decompress the air cells 40. FIG. 4 illustrates an example of a time chart of the internal pressure of the air cells 40 in the decompression control. First, as illustrated in FIG. 4, the air is discharged from the air cell ZF 42 for a set period of time. During the set switch time, the internal pressure of a corresponding one of the air cells 40 is adjusted under the internal pressure adjustment control. Then, the air is discharged from the air cell ZB 43 for a set period of time. Also on that occasion, the internal pressure of a corresponding one of the air cells 40 is adjusted under the internal pressure adjustment control.

The internal pressure adjustment control is performed to adjust the internal pressure of a corresponding one of the air cells 40. In the internal pressure adjustment control, the internal pressure of a corresponding one of the air cells 40 is obtained by the pressure sensor 1. After the lapse of 1 second while the internal pressure is less than −0.5 kPa of the set pressure value, the control moves to "air supply control". On the other hand, after the lapse of 1 second while the internal pressure is +0.5 kPa of the set pressure value or more, the control moves to "air discharge control". Otherwise, the control returns to the original control.

The air supply control is performed to increase the internal pressure of a corresponding one of the air cells 40. In the air supply control, the air pump is turned on. The air pump is turned off when the internal pressure of the air cell 40 becomes+0.5 kPa of the set pressure value or more.

The air discharge control is performed to reduce the internal pressure of the air cells 40. In the air discharge control, a corresponding one of the solenoid valves is opened to discharge the air. After the lapse of X seconds while the internal pressure obtained by the pressure sensor 1 is different from the set pressure value by X kPa, the corresponding solenoid valve is closed.

(Control Procedure<Set Value Table>)

In the control unit 20 of the embodiment, the values of the internal pressure of the air cells 40 are set, for example, as illustrated in FIG. 5. Specifically, for the firmness level "soft", the internal pressure is set to 4.0 kPa in the stable mode and 4.2 kPa in the decompression mode. For the firmness level "medium", the internal pressure is set to 5.2 kPa in the stable mode and 5.5 kPa in the decompression mode. For the firmness level "firm", the internal pressure is set to 6.5 kPa in the stable mode and 6.8 kPa in the decompression mode. Note that in providing the seat cushion 10, the pressure values are not limited to those exemplified above.

Further, in the control unit 20 of the embodiment, the discharge/switch time in the decompression mode is set, for example, as illustrated in FIG. 6. Specifically, for the firmness level "soft", the air discharge time for the air cell ZF 42 is set to 12 seconds, the switch time is set to 20 seconds, and the air discharge time for the air cell ZB 43 is set to 10 seconds. For the firmness level "medium", the air discharge time for the air cell ZF 42 is set to 13 seconds, the switch time is set to 22 seconds, and the air discharge time for the air cell ZB 43 is set to 11 seconds. For the firmness level "firm", the air discharge time for the air cell ZF 42 is set to 14 seconds, the switch time is set to 24 seconds, and the air discharge time for the air cell ZB 43 is set to 12 seconds. In this manner, in the embodiment, the switch time between the air cell ZF 42 and the air cell ZB 43 (20 seconds for "soft", 22 seconds for "medium", and 24 seconds for "firm") is controlled such that the air discharge from the air cell ZB 43 starts immediately after the air supply to the air cell ZF 42 is completed. As a result, even when the air cell ZF 42 and the air cell ZB are alternately decompressed, the decompression and stability of the ischial region can be achieved at the same time. Note that in providing the seat cushion 10, periods of the discharge/switch time are not limited to those exemplified above.

The control unit 20 performs the decompression operation as described above so as to cause ventilation to occur through the groove 31 formed in the base material 30 and the slit 51 between the second air cell section 42 and the third air cell section 43 located inside the position corresponding to the boundary 50, which helps the user feel less stuffy and sweaty around their ischial region.

Although specific embodiments of the invention have been described and illustrated, it is to be understood that the invention is not to be limited to the embodiments disclosed herein. As would be apparent to those skilled in the art, various changes, modifications, and alterations may be made within the scope of the invention as defined in the appended claims.

The invention claimed is:

1. A seat cushion comprising:

a second air cell section that is located on a rear side of a seat surface;

a third air cell section that is located rearward of the second air cell section; and a control unit configured to cause the second air cell section and the third air cell section to be alternately decompressed, wherein the second air cell section and the third air cell section are adjacent to each other and have a common boundary extending diagonally in a front-rear direction of the seat surface such that an ischial region of a user fits in the boundary wherein the control unit is further configured to perform decompression to cause ventilation to occur through a groove formed in a base material of the seat cushion and a slit between the second air cell section and the third air cell section located inside a position corresponding to the boundary.

2. The seat cushion according to claim 1, wherein the second air cell section is configured to support part of buttocks of the user anterior to the ischial region, and the third air cell section is configured to support part of the buttocks of the user posterior to the ischial region.

3. The seat cushion according to claim 1, wherein the control unit is further configured to control alternate decompression of the second air cell section and the third air cell section such that the second air cell section or the third air cell section is decompressed for 3 to 120 seconds.

4. The seat cushion according to claim 1, further comprising a first air cell section that is located on a front side of the seat surface forward of the second air cell section.

5. The seat cushion according to claim 4, wherein the first air cell section is configured to support thighs of the user.

6. The seat cushion according to claim 1, further comprising a first air cell section that is located on a front side of the seat surface forward of the second air cell section, wherein the first air cell section is configured to support thighs of the user, and the control unit is further configured to cause the first air cell section to constantly support the thighs of the user.

* * * * *